US006322288B1

(12) United States Patent
DiTullio

(10) Patent No.: US 6,322,288 B1
(45) Date of Patent: Nov. 27, 2001

(54) STORM OR WASTE WATER CHAMBER FEATURING STRAIN RELIEF NOTCHES FOR FLEXING AND CONTOURING THE CHAMBER

(76) Inventor: Robert J. DiTullio, 38 Hidden Brook Dr., Brookfield, CT (US) 06804

( * ) Notice: Subject to any disclaimer, the term of this patent is extended or adjusted under 35 U.S.C. 154(b) by 0 days.

(21) Appl. No.: 09/542,079

(22) Filed: Apr. 3, 2000

Related U.S. Application Data

(60) Provisional application No. 60/184,272, filed on Feb. 23, 2000.

(51) Int. Cl.[7] ..... E02B 13/00

(52) U.S. Cl. ..... 405/43; 405/49; 138/121

(58) Field of Search ..... 405/36, 43, 45, 405/49; 38/121, 122, 173

(56) References Cited

U.S. PATENT DOCUMENTS

| | | | | |
|---|---|---|---|---|
| 980,442 | | 1/1911 | Schlafly . | |
| 1,013,440 | | 1/1912 | Rankin et al. . | |
| 1,071,185 | | 8/1913 | Shannon . | |
| 1,349,734 | | 8/1920 | Riley . | |
| 1,889,325 | | 11/1932 | Whaley . | |
| 2,996,189 | | 8/1961 | Salterbach . | |
| 3,282,430 | | 11/1966 | Kinne . | |
| 3,339,366 | | 9/1967 | Gogan et al. . | |
| 3,440,823 | * | 4/1969 | Olsen | 405/43 |
| 3,495,410 | | 2/1970 | Bailey et al. . | |
| 3,926,222 | | 12/1975 | Shroy et al. . | |
| 4,192,628 | | 3/1980 | Gorman . | |
| 4,245,924 | | 1/1981 | Fouss et al. . | |
| 4,319,998 | | 3/1982 | Anderson . | |
| 4,523,613 | | 6/1985 | Fouss et al. . | |
| 4,588,325 | | 5/1986 | Seefert . | |
| 4,598,277 | * | 7/1986 | Feldman | 340/604 |
| 4,650,367 | | 3/1987 | Dietzler . | |
| 4,689,145 | | 8/1987 | Mathews et al. . | |
| 4,759,661 | | 7/1988 | Nichols et al. . | |
| 4,919,568 | | 4/1990 | Hurley . | |
| 4,995,759 | | 2/1991 | Plowman et al. . | |
| 5,087,151 | | 2/1992 | DiTullio . | |
| 5,129,757 | | 7/1992 | Johnson . | |
| 5,267,122 | | 11/1993 | Glover et al. . | |
| 5,419,838 | | 5/1995 | DiTullio . | |
| 5,556,231 | * | 9/1996 | Sidaway et al. | 405/43 X |
| 5,720,577 | | 2/1998 | Sanders et al. . | |
| 5,773,756 | | 6/1998 | DiTullio . | |
| 6,129,482 | * | 10/2000 | Ditullio | 405/43 |

FOREIGN PATENT DOCUMENTS 1330603 7/1994 (CA) .

OTHER PUBLICATIONS

"Worth looking at . . . from any angle." by Norwesco Fluid Systems Division, Water and Waste Management Products, 1987 Norwesco Inc./Walton–Mattson Advertising, WWM30M687, pp 1,2,5–9.

"For The Serious Treatment Of On–Site Wastewater And/Or Stormwater . . . Give Your Customer A High Quality, Cost Effective Cultec Chamber System" Brochure by Cultec, Inc., pp 1–4, Undated.

* cited by examiner

*Primary Examiner*—David Bagnell
*Assistant Examiner*—Sunil Singh
(74) *Attorney, Agent, or Firm*—Ware, Fressola, Van Der Sluys & Adolphson LLP

(57) ABSTRACT

A chamber is provided that is flexible and able to be contoured along the entire length of the chamber when deployed on rock and earth formations with variable gradings. The chamber has a multiplicity of stress relief notches (also known as flex ports) formed on both sides at the base of the chamber Substantially along the entire length of the chamber. Each stress relief notch is formed between a respective pair of protruding ribs along substantially the entire length of the chamber so the chamber can flex in an accordion-like or caterpillar-like manner. The chamber may be molded to include the strain relief notches.

16 Claims, 6 Drawing Sheets

| MODEL | AVAILABLE DEFECTION (PER 100') |
|---|---|
| FIELD DRAIN™ PANEL C-1 | 10' |
| FIELD DRAIN™ PANEL C-2 | 9' |
| FIELD DRAIN™ PANEL C-3 | 2.5' |
| FIELD DRAIN™ PANEL C-4 | 1' |
| CONTACTOR™ MODEL EZ-24 | 25' |
| CONTACTOR™ MODEL 75 | 8' |
| CONTACTOR™ MODEL 100 | 6' |
| CONTACTOR™ MODEL 125 | 8' |
| RECHARGER™ MODEL 180 | 6' |
| RECHARGER™ MODEL 330 | 5' |
| RECHARGER™ MODEL 400 | 6.5' |

STORM OR WASTE WATER CHAMBER FEATURING STRAIN RELIEF NOTCHES FOR FLEXING AND CONTOURING THE CHAMBER

RELATED PATENT APPLICATIONS

This patent application is a continuation of and claims benefit to provisional patent application Ser. No. 60/184,272 (WFVA File No. 2-435-29), filed Feb. 23, 2000, entitled "Storm or Waste Water Chamber Featuring Strain Relief Notches for Improved Flexibility and Contourability," which is hereby incorporated by reference in its entirety.

BACKGROUND OF THE INVENTION

1. Field of the Invention

The present invention is a chamber for managing storm or waste water.

2. Description of Related Art

The inventor of the subject matter of the present patent application has a number of issued United States patents and pending United States patent applications on galleries and chambers for managing storm or waste water that are known in the art. The reader is referred to U.S. Pat. No. 5,087,151, entitled "Drainage System;" U.S. Pat. No. 5,419,838, entitled "Groundwater Storage and Distribution System having a Gallery and Filtering Means;" United States provisional patent application Ser. No. 60/063,896, filed Oct. 31, 1997, as well as U.S. Pat. No. 6,129,482, both entitled "Reversible Interlocking Field Drain Panel," all owned by the instant inventor and incorporated by reference in their entirety, for a detailed description of how the galleries or chambers are made and used in the water management industry. The inventor's galleries or chambers have been applied to other areas of technology, see U.S. Pat. No. 5,773,756, entitled "Lightweight and Durable Utility Pull Box for Protecting Slices and Junctions of Underground Coaxial Cables, Electrical Wires and Optical Fiber", also incorporated by reference in its entirety.

In particular, the aforementioned U.S. Pat. No. 6,129,482 shows a reversible interlocking field drain panel having twenty five transverse strengthening ribs and three lateral transfer tunnels or side transfer openings (See reference label T3). One of the lateral transfer tunnels or side transfer openings is located substantially in the middle of the chamber, while the other two are located at about one quarter and three quarters along the length of the chamber, The lateral transfer tunnels or side transfer openings have a halfmoon-dimension for fitting one half of a four inch pipe (i.e., having a four inch diameter) and function to transfer water or liquid from tunnel to tunnel. The lateral transfer tunnels or side transfer openings do not provide meaningful lateral or transverse flexing along the length of the chamber.

SUMMARY OF THE INVENTION

The present invention provides a new and unique chamber that is flexible and able to be contoured along the entire length of the chamber when deployed on rock and earth formations with variable gradings.

The chamber (a.k.a. the EZ-24 chamber) has a multiplicity of stress relief notches (also known as flex ports) formed on both sides at the base of the chamber substantially along the entire length of the chamber. In one embodiment, a separate stress relief notch is formed between respective pair of protruding ribs along substantially the entire length of the chamber so the chamber can flex in an accordion-like or caterpillar-like manner. The chamber may be flexed or contoured horizontally (i.e. laterally), vertically (i.e. transversely) or a combination thereof with respect to the ground plane along the length of the chamber. The chamber may be molded to include the strain relief notches.

DESCRIPTION OF THE BEST MODE OF THE INVENTION FIGS. 1A, 1B, 1C, 1D

Figure 1A:
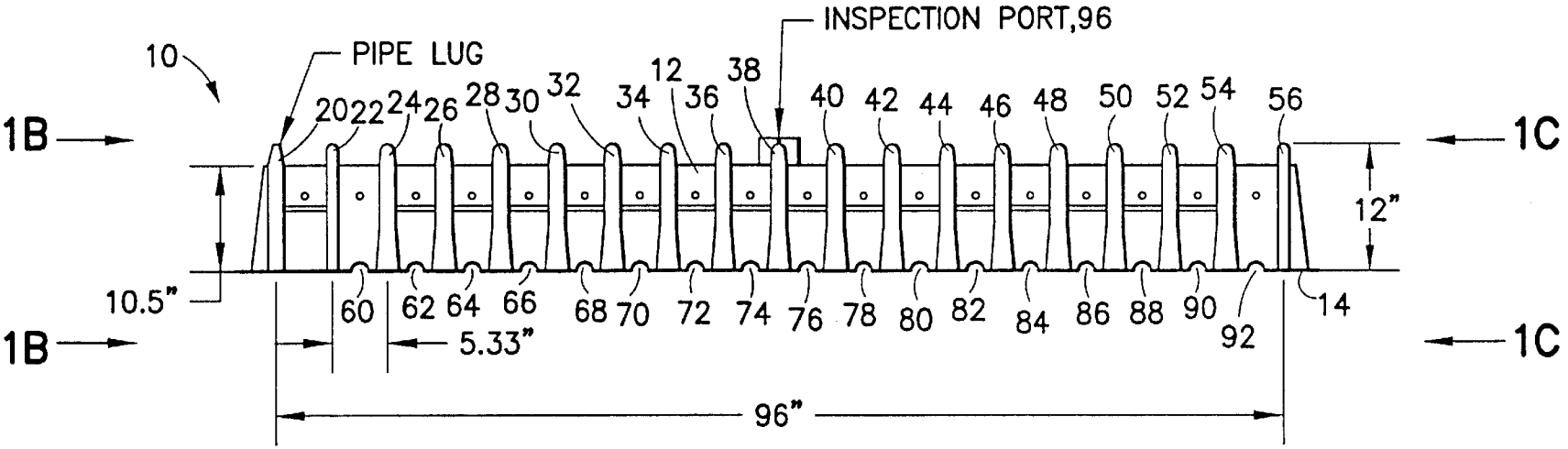
FIG. 1A is a side view of a chamber that is the subject matter of the present invention.

FIGS. 1A, 1B, 1C, 1D show a new and unique chamber generally indicated as 10 including an arched-housing 12 with a base generally indicated as 14, a multiplicity of protruding transverse circumferential strengthening ribs 20, 22, 24, 26, 28, 30, 32, 34, 36, 38, 40, 42, 44, 46, 48, 50, 52, 54, 56 and a corresponding multiplicity of stress relief notches 60, 62, 64, 66, 68, 70, 72, 74, 76, 78, 80, 82, 84, 86, 88, 90, 92 (also known as flex ports).

The multiplicity of protruding transverse circumferential strengthening ribs 20, 22, 24, 26, 28, 30, 32, 34, 36, 38, 40, 42, 44, 46, 48, 50, 52, 54, 56 extend substantially along the entire length of the arched-housing 12.

The corresponding multiplicity of stress relief notches 60, 62, 64, 66, 68, 70, 72, 74, 76, 78, 80, 82, 84, 86, 88, 90, 92 are disposed on the base 14 substantially along the entire length of the arched-housing 12. FIG. 1D shows that the stress relief notches 60, 62, 64, 66, 68, 70, 72, 74, 76, 78, 80, 82, 84, 86, 88, 90, 92 are formed on both sides along the base 14 of the chamber 10. Each stress relief notch 60, 62, 64, 66, 68, 70, 72, 74, 76, 78, 80, 82, 84, 86, 88, 90, 92 is arranged between a respective pair of the protruding transverse circumferential strengthening ribs 22, 24; 24, 26; 26, 28; 28, 30; 30, 32; 32, 34; 34, 36; 36, 38; 38, 40; 40, 42; 42, 44; 44, 46; 46, 48; 48, 50; 50, 52; 52, 54; 54, 56 so the chamber can flex along its length and width in an accordion-like or caterpillar-like manner for contouring the chamber when deployed on rock and earth formations with variable gradings.

Each stress relief notch 60, 62, 64, 66, 68, 70, 72, 74, 76, 78, 80, 82, 84, 86, 88, 90, 92 is arched-shaped and is about 0.75 inches high and 1.25 inches wide at the base. The length of the chamber 10 is about 96 to 102 inches. The height of the chamber 10 is about 12 inches from the top of a respective protruding transverse circumferential strengthening rib 20, 22, 24, 26, 28, 30, 32, 34, 36, 38, 40, 42, 44, 46, 48, 50, 52, 54, 56 to the base 14. As shown, the respective pair of the protruding transverse circumferential strengthening ribs 22, 24; 24, 26; 26, 28; 28, 30; 30, 32; 32, 34; 34, 36; 36, 38; 38, 40; 40, 42; 42, 44; 44, 46; 46, 48; 48, 50; 50, 52; 52, 54; 54, 56 are spaced at a distance of about 5⅓ inches. Similarly, adjacent pairs of stress relief notches 60, 62, 64, 66, 68, 70, 72, 74, 76, 78, 80, 82, 84, 86, 88, 90, 92 are spaced at a distance of about 5⅓ inches. Two protruding transverse circumferential strengthening ribs 22, 56 are "smaller" ribs for interlocking similar to that shown and described in U.S. patent application Ser. No. 09/183,111. The chamber 10 has a width of about 16 inches. The scope of the invention is also intended to cover embodiments having other dimensions, including embodiments having substantially the same proportionalities.

The chamber 10 may be molded from of a high molecular weight/high density polyethylene. The scope of the invention is also intended to cover embodiments having other types of materials, including other types of polymeric materials.

Figure 1C:
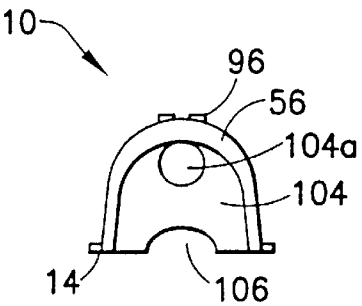
FIG. 1C is an end view of the chamber in FIG. 1A along lines 1C—1C.
Figure 1B:
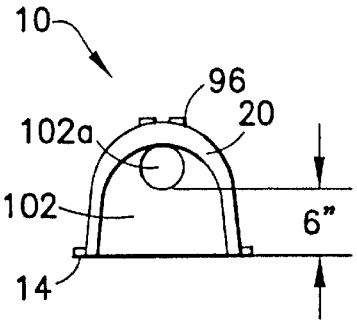
FIG. 1B is an end view of the chamber in FIG. 1A along lines 1B—1B.
Figure 1D:
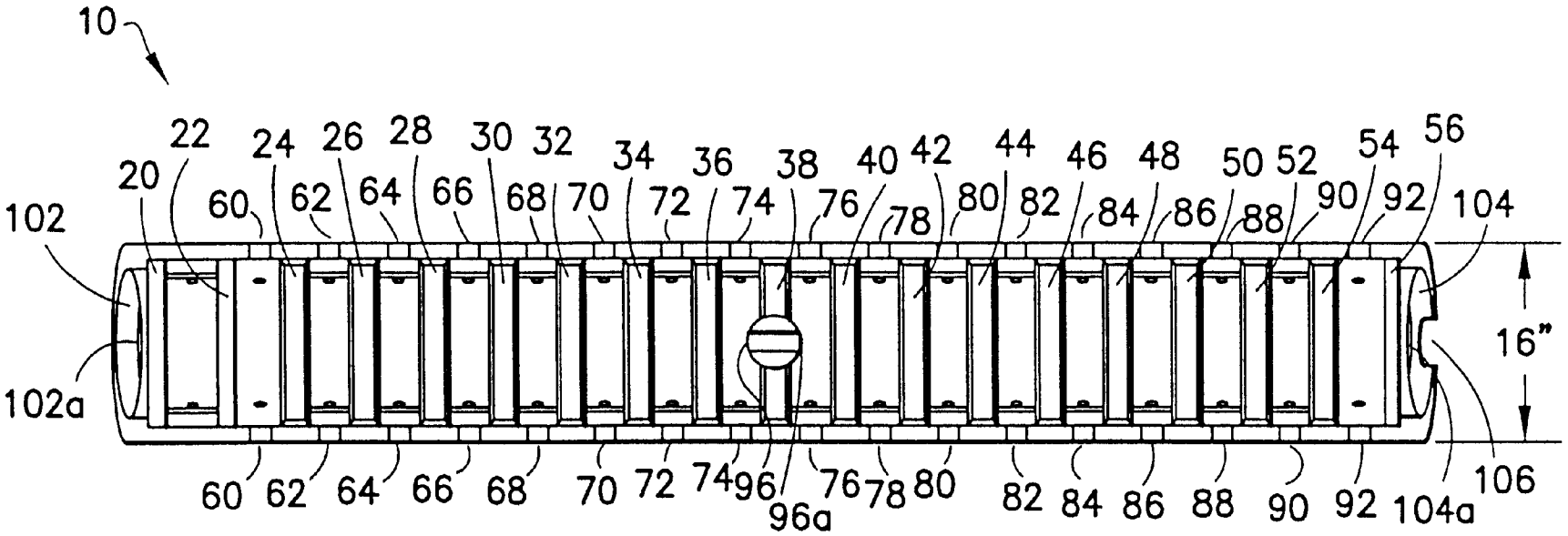
FIG. 1D is a top view of the chamber in FIG. 1A.
Figure 2:
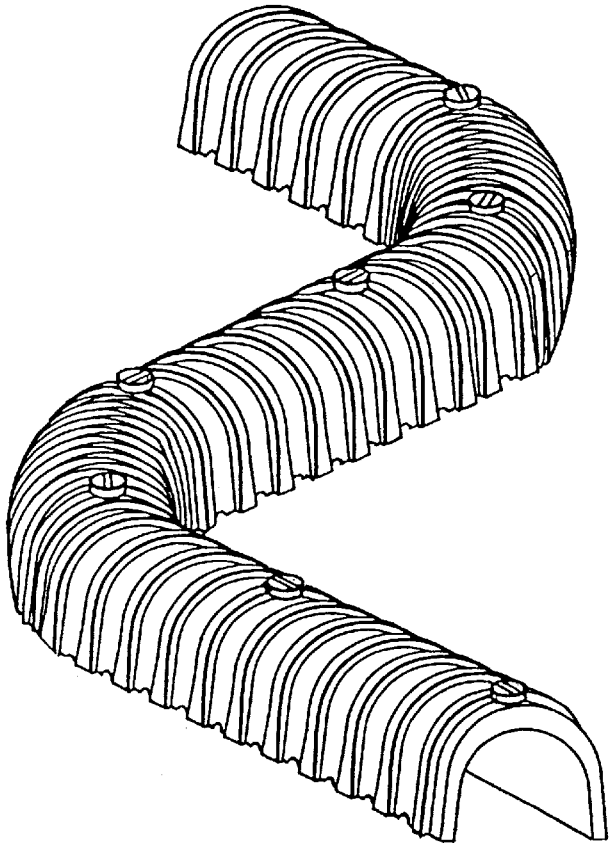
FIG. 2 is a photo of the chamber shown in FIG. 1A with a curved deflection along a ground plane.
Figure 4:
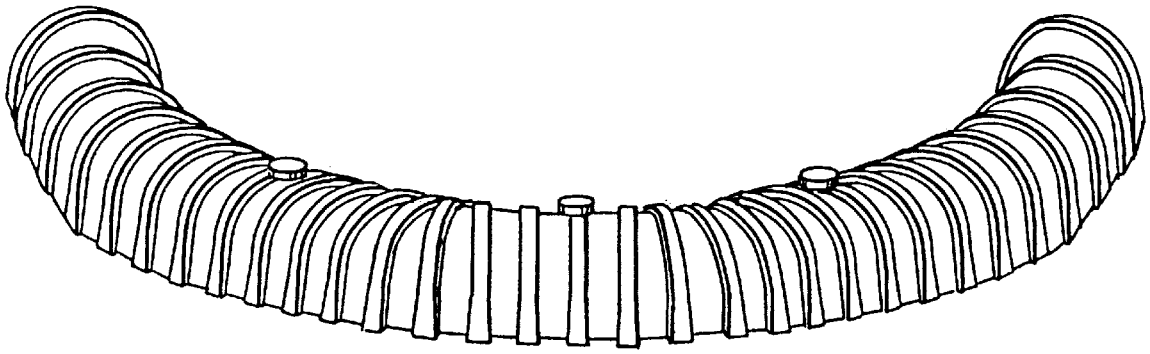
FIG. 4 is a photo of the chamber shown in FIG. 1A with a circular deflection along a ground plane.
Figures 3, 5:
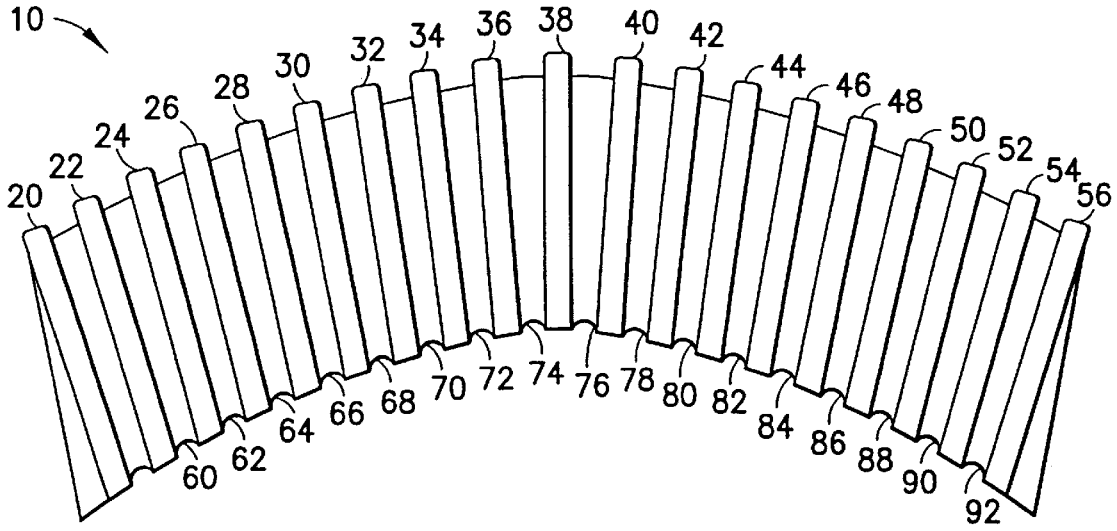
FIG. 3 is a chart showing models and available deflection per 100 feet.
FIG. 5 is a diagram of a chamber with a deflection transverse to a ground plane.

In FIGS. 1A, 1D, the chamber 10 has a raised center inspection port 96. The raised center inspection port has a recessed trough 96*a* to enable support and locating assistance for PVC pressure distribution or gravity feed pipe (not shown).

In FIGS. 1B and 1C, the chamber 10 has ends 102, 104 with openings 102*a*, 104*a* for receiving transport piping (not shown) having water or other effluent. In FIG. 1C, the chamber end 104 has a lower opening 106 for receiving transport piping (not shown), water or other effluent.

The chamber 10 has a straight line deflection in a range of 5–25 feet per 100 feet.

In FIGS. 1A and 1D, the stress relief notches 60, 62, 64, 66, 68, 70, 72, 74, 76, 78, 80, 82, 84, 86, 88, 90, 92 are shown as having an arched shape. However, the scope of the invention is not intended to be limited to any particular shape of the stress relief notches or arches. Embodiments are envisioned in which the stress relief notches are shaped triangularly, squarely, or like a hexagon or diamond. Embodiments are envisioned in which the dimensions of the notch or arch have many different dimensions, so the scope of the invention is not intended to be limited to any particular set of dimensions.

Figure 6:
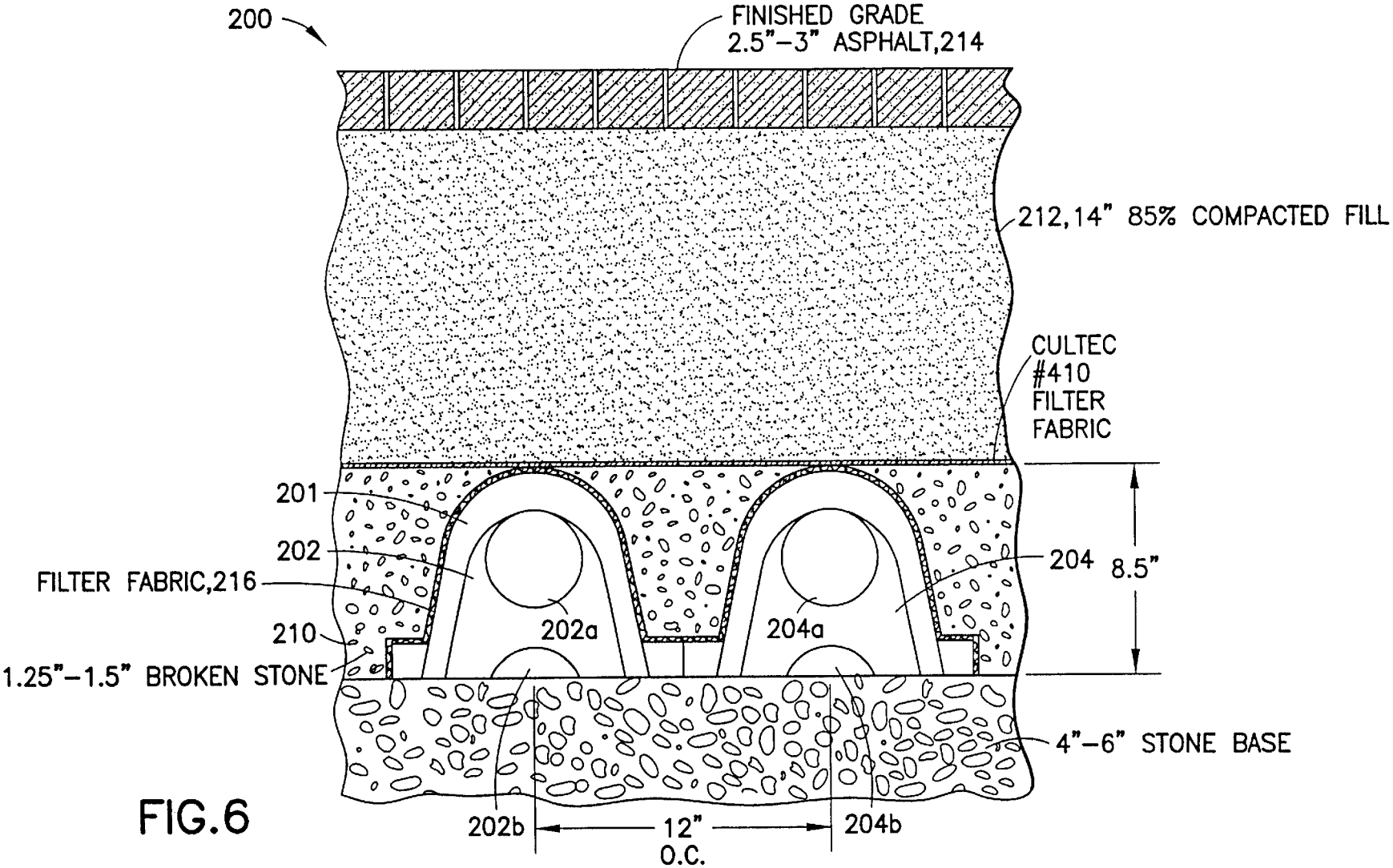
FIG. 6 shows a section through a field drain bed having a field drain panel that is the subject matter of the present invention.

FIG. 6: The Field Drain Panel

FIG. 6 shows a section through a field drain bed generally indicated as 200 having one or more field drain panels 201, which is described in more detail in U.S. Pat. No. 6,129,482. The field drain panel 201 has ends 202, 204 with openings 202*a*, 204*a* for receiving transport piping (not shown) having water or other effluent. The chamber end 202, 204 has a lower opening 202*b*, 204*b* for receiving transport piping (not shown), water or other effluent. The field drain panel 201 may include stress relief notches for providing flexing and contourability.

The field drain panel has a straight line deflection in a range of 1–10 feet per 100 feet.

As shown, the field drain panel 200 rests in a 4"–6" stone base 210 of 1.25–1.5" broken stone, has a 14" compacted fill (85%) covering 212, and is finished with a 2.5–3" asphalt grading 214. The calculations are based on a 40% void. An optional filter fabric 216 may be placed over and cover the field drain panel 200. A typical application may be deploying one or more of the field drain panels 200 under a parking lot.

In the field drain bed 200, the one or more field drain panels 201 may be replaced by one or more chambers like the chamber 10 shown in FIGS. 1A, 1B, 1C, 1D.

Figure 7:
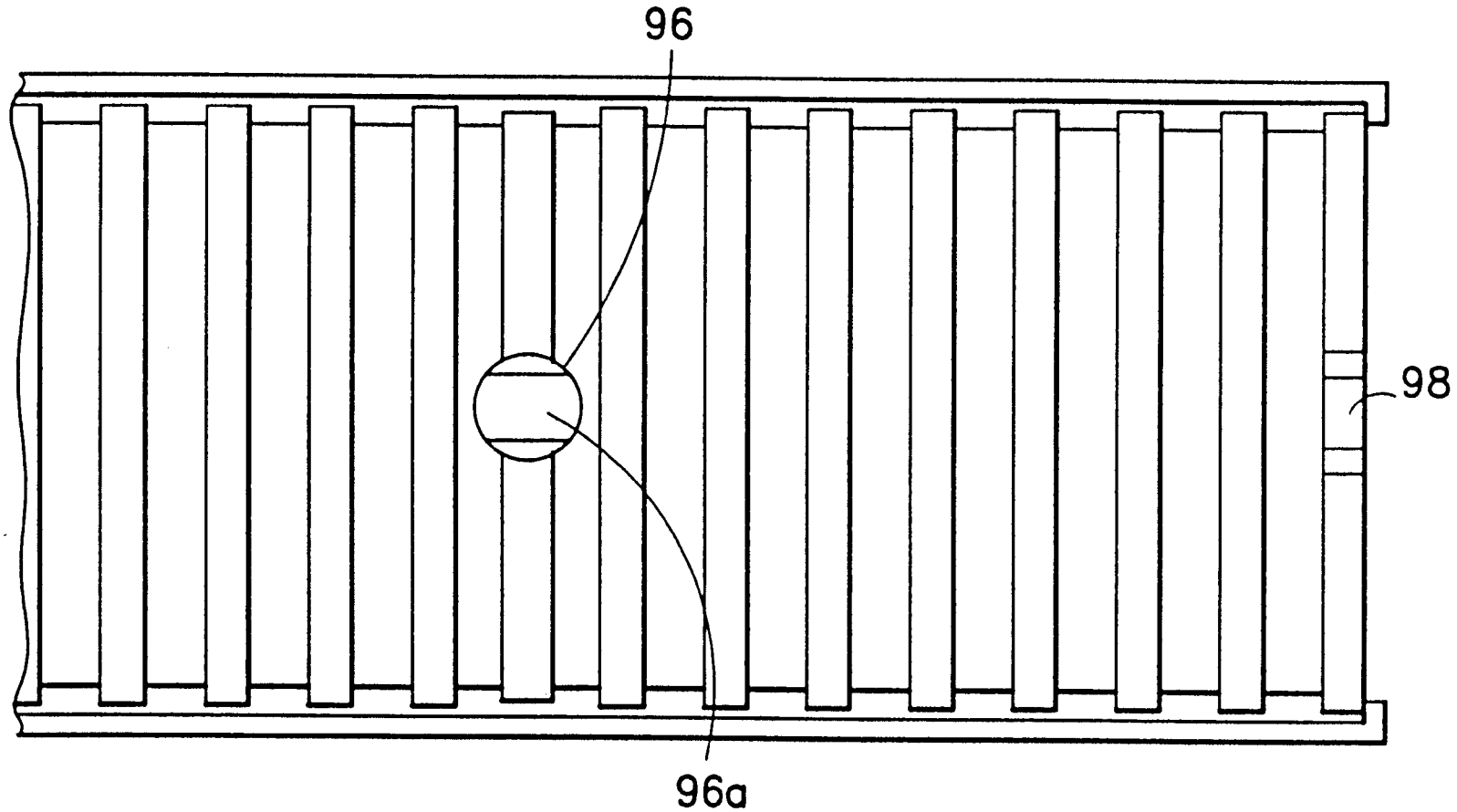
FIG. 7 shows a top view of an embodiment of the chamber having a pipe carrier on the top thereof and a location where a raised part of a trough so a pipe won't pull out.

FIG. 7: Humped Raised Portion Between Ribs

FIG. 7 shows an embodiment in which the chamber has the pipe carrier or cradle generally indicated as 98 that is 20 formed on the top of the chamber rib, allowing the pipe to "slide" on top of the chamber. In effect, a "hump" (raised portion) could also be formed between ribs, allowing the pipe to "slide" on top of the chamber.

Raised Part of Trough

FIG. 7 also show a location for the raised part 96 of a trough on the chamber so the pipe won't pull off. This is attained by use of raised lettering in combination with a little knob.

The Scope of the Invention

It is also to be understood that the intended claims will be drafted in a regular United States patent application to cover all of the generic and specific features of the invention herein described and all statements of the scope of the invention which, as a matter of language, might be said to fall therebetween.

What is claimed is:

1. A chamber comprising:

an arched-housing having a base and having a multiplicity of protruding transverse circumferential strengthening ribs extending substantially along the entire length of the arched-housing; and a corresponding multiplicity of stress relief notches disposed on the base substantially along the entire length of the arched-housing, each stress relief notch being arranged between a respective pair of the protruding transverse circumferential strengthening ribs so the chamber can flex along its length and width in an accordion-like or caterpillar-like manner for contouring the chamber when deployed on rock and earth formations with variable gradings.

2. A chamber according to claim 1, wherein each stress relief notch has an arch shape and is about 0.75 inches high and 1.25 inches wide at the base.

3. A chamber according to claim 1, wherein the length of the chamber is about 96 to 102 inches.

4. A chamber according to claim 1, wherein the height of the chamber is about 12 inches from the top of a respective protruding transverse circumferential strengthening rib to the base.

5. A chamber according to claim 1, wherein the respective pair of the protruding transverse circumferential strengthening ribs are spaced at a distance of about 5⅓ inches.

6. A chamber according to claim 1, wherein the chamber has a width of about 16 inches.

7. A chamber according to claim 1, wherein the chamber has a straight line deflection in a range of 5–25 feet per 100 feet.

8. A chamber according to claim 1, wherein the chamber is formed of a high molecular weight/high density polyethylene.

9. A chamber according to claim 1, wherein the chamber has a raised center inspection port.

10. A chamber according to claim 9, wherein the raised center inspection port has a recessed trough to enable support and locating assistance for PVC pressure distribution or gravity feed pipe.

11. A chamber according to claim 1, wherein adjacent pairs of stress relief notches are spaced at a distance of about 5⅓ inches.

12. A field drain panel having a plurality of chambers, each comprising:

an arched-housing having a base and having a multiplicity of protruding transverse circumferential strengthening ribs extending substantially along the entire length of the arched-housing; and a corresponding multiplicity of stress relief notches disposed on the base substantially along the entire length of the arched-housing, each stress relief notch being arranged between a respective pair of the protruding transverse circumferential strengthening ribs so the chamber can flex along its length and width in an accordion-like or caterpillar-like manner for contouring the chamber when deployed on rock and earth formations with variable gradings.

13. A field drain panel according to claim 12, wherein the field drain panel has a straight line deflection in a range of 1–10 feet per 100 feet.

14. A field drain panel according to claim 12, wherein each stress relief notch has an arch shape and is about 0.75 inches high and 1.25 inches wide at the base.

15. A field drain panel according to claim 12, wherein the respective pair of the protruding transverse circumferential strengthening ribs are spaced at a distance of about 5⅓ inches.

16. A field drain panel according to claim 13, wherein adjacent pairs of stress relief notches are spaced at a distance of about 5⅓ inches.

* * * * *